US005634221A

United States Patent [19]

McKinney

[11] Patent Number: 5,634,221

[45] Date of Patent: Jun. 3, 1997

[54] PRONE CART

[76] Inventor: Michael L. McKinney, 5301 252nd St. East, Graham, Pierce County, Wash. 98338

[21] Appl. No.: 617,499

[22] Filed: Mar. 15, 1996

[51] Int. Cl.[6] ..... A61G 1/02

[52] U.S. Cl. ..... 5/620; 296/20

[58] Field of Search ..... 5/600, 620, 86.1; 296/20; 297/44, 45; 280/304.1, 642, 643, 644, 647

[56] References Cited

U.S. PATENT DOCUMENTS 1,500,858 7/1924 Woods ..... 296/20

4,776,605 10/1988 Hathcock ..... 5/86.1

*Primary Examiner*—Rodney M. Lindsey

*Assistant Examiner*—Robert G. Santos

*Attorney, Agent, or Firm*—James F. Leggett

[57] ABSTRACT

A wheeled cart to provide light weight, collapsible and portable mobility for individuals who have the need to be in the prone position. The bed of the cart and the two large front wheels are provided with quick disconnect means and the two sides of the tubular frame of the prone cart fold easily together for transport.

2 Claims, 3 Drawing Sheets

FIG. 1
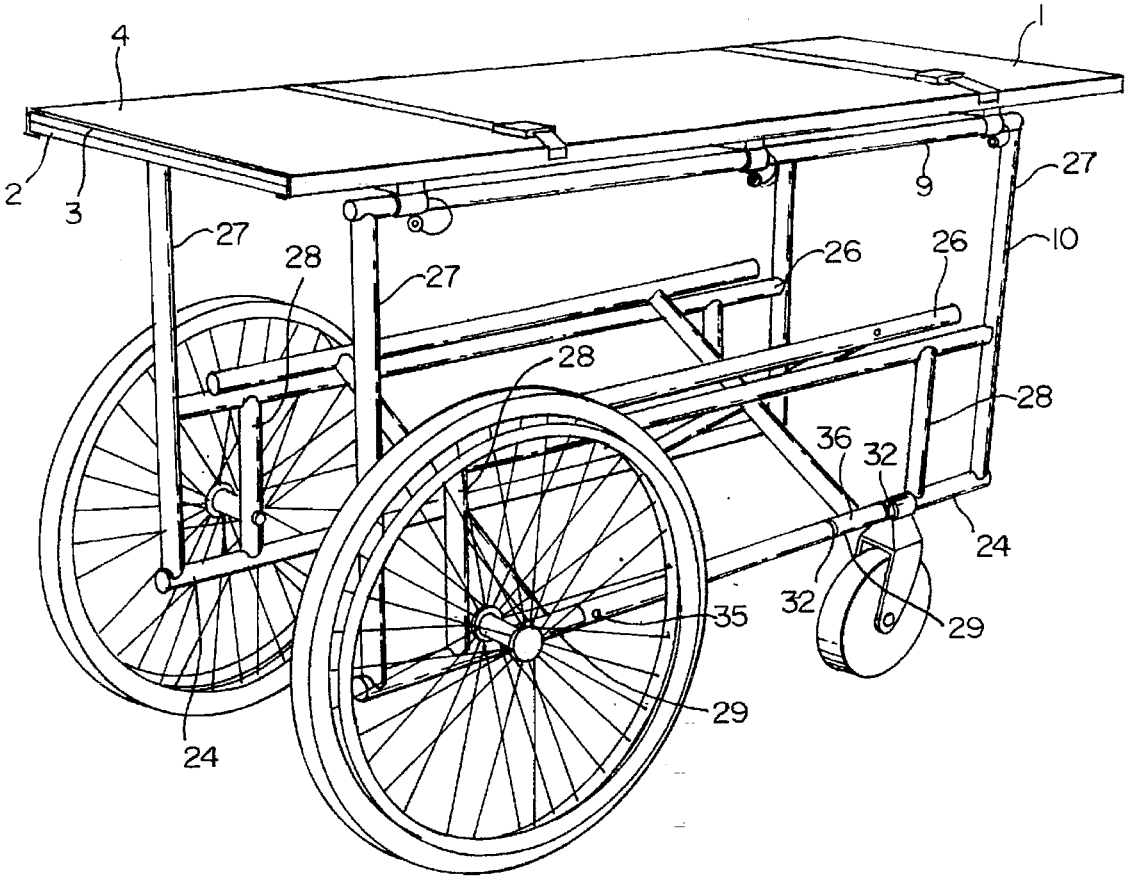
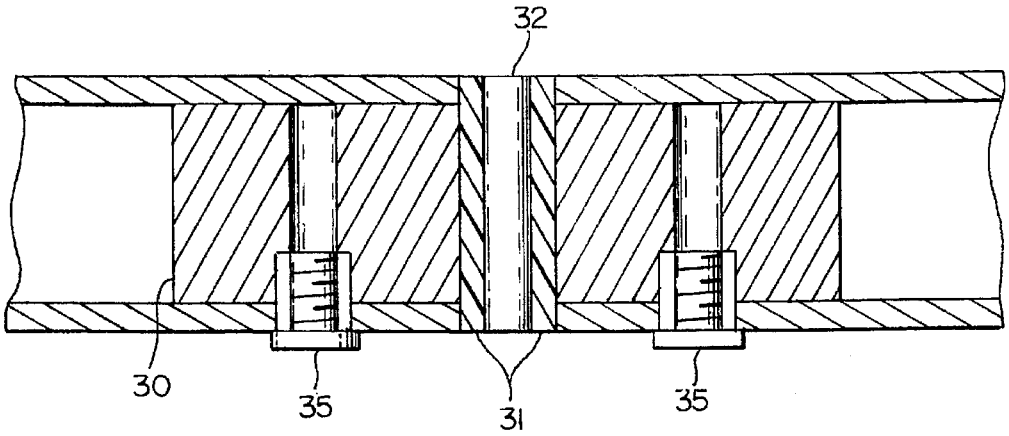
FIG. 2

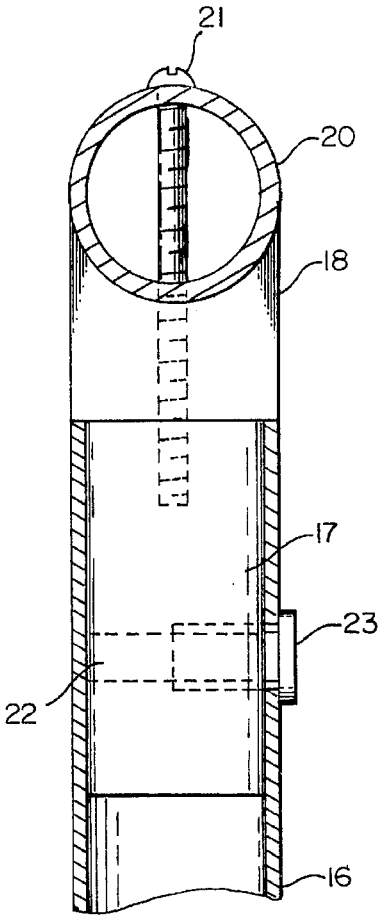
FIG. 3
FIG. 4
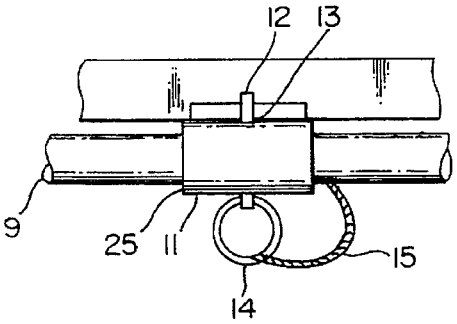
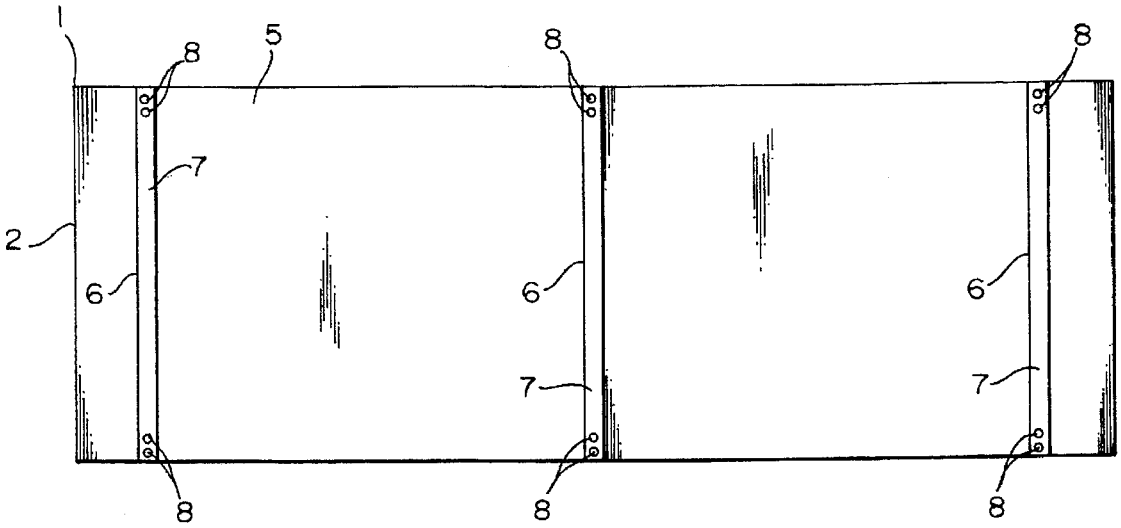
FIG. 5

PRONE CART

BACKGROUND OF THE INVENTION

This invention relates generally to an improved means of light-weight, collapsible, and portable mobility for individuals who must be in the prone position, such as those having a physical handicap.

In the past, prone boards have been equipped with wheels, such as the Ambulatory Wheelstand disclosed in Daniel W. Davis U.S. Pat. No. 4,620,714, see also L. E. Hoffman's Hospital Buggy, U.S. Pat. No. 651,605, W. F. Berstein's Vehicle for Hospital and Other Purposes, U.S. Pat. No. 922,841, W. F. Bernstein's Stretcher for Hospital and Other Purposes, U.S. Pat. No. 970,877 and L. Q. Peterson's Mobile Carrier, U.S. Pat. No. 2,715,030. Some of these have been combined with a collapsible support frame, such as R. L. Hastings' Foldable Utility Cart, U.S. Pat. No. 3,223,429, I. C. Klingler's Collapsible Stretcher, U.S. Pat. No. 2,596,250, E. Sullivan's Portable Cot, U.S. Pat. No. 2,360,453, O. L Herod's Stretcher, U.S. Pat. No. 1,924,496, and H. Liedtke's Folding Stretcher, U.S. Pat. No. 1,483,607. However, there has not been a device, which allows individuals who must be prone to be self-mobile, while being capable of rapid and easy collapse and portability.

Therefore, the primary object of this invention is to provide people who must be prone the means to move about in our society less encumbered and to make the task of their supporters easier. Individuals who must be prone rely upon others for much of their mobility, i.e. interfacing with various modes transportation other than their personal mobility device. It has long been known that there is a need to make these personal mobility devices, such as wheel chairs, stretchers and carts, as portable as possible, so that they may accompany the disabled individual on other modes of transportation. This invention will greatly reduce the task of those who support such individuals and thus increase the mobility of such individuals throughout the spectrum of modes of transportation.

SUMMARY OF THE INVENTION

The foregoing objectives are satisfied by this invention, which is comprised of an open sided, wheeled cart having a mobile mattress, removably attached to a top pair of tubular parallel bars, held in fixed relation to each other by means of an "X" support, the top of the arms of which are readily freed from a set of parallel bars located near the mid-point of the sides so as to enable the frame to fold for travel. The bottom of the "X" frame is comprised of a section of aluminum tubing inserted within the span of the bottom parallel bar of a side by means of a sleeve of phenolic material of slightly smaller outside diameter than the inside diameter of the tube of the "X" frame and the bottom parallel bar, so that the bottom of the "X" frame can smoothly rotate around the circumference of the bottom parallel bar. The mobile mattress is removably mounted to the top pair of parallel bars by means of saddle clamps. The frame is of tubular aluminum construction resting on standard axle and wheel means and wheel chair wheels with standard quick release hubs, on one end, and small steerable wheels mounted by standard caster means on the opposite end of the cart.

The novel features of the invention will be best understood from the following description in light of the accompanying drawings. While particular embodiments of the present invention are shown and described, it will be obvious to those skilled in the art that changes and modifications may be made without departing from this invention in its broader aspects and, therefore, the aim of the appended claims is to cover all such changes and modifications as fall within the true spirit and scope of this invention.

BRIEF DESCRIPTION OF THE DRAWINGS

FIG. 1 is a view from the left front of a cart made according to my invention.

FIG. 2 is an expanded view of the base of the "X" frame rotatably communicating with the bottom parallel tubular side of the cart.

FIG. 3 is a cross-sectional view of the preferred means of joining the aluminum tubing used in my invention.

FIG. 4 is an expanded view of the means of removably attaching the bed to the top parallel bars of my invention.

FIG. 5 is a plane view of the underside of the bed.

DESCRIPTION OF THE PREFERRED EMBODIMENTS

Figure 6:
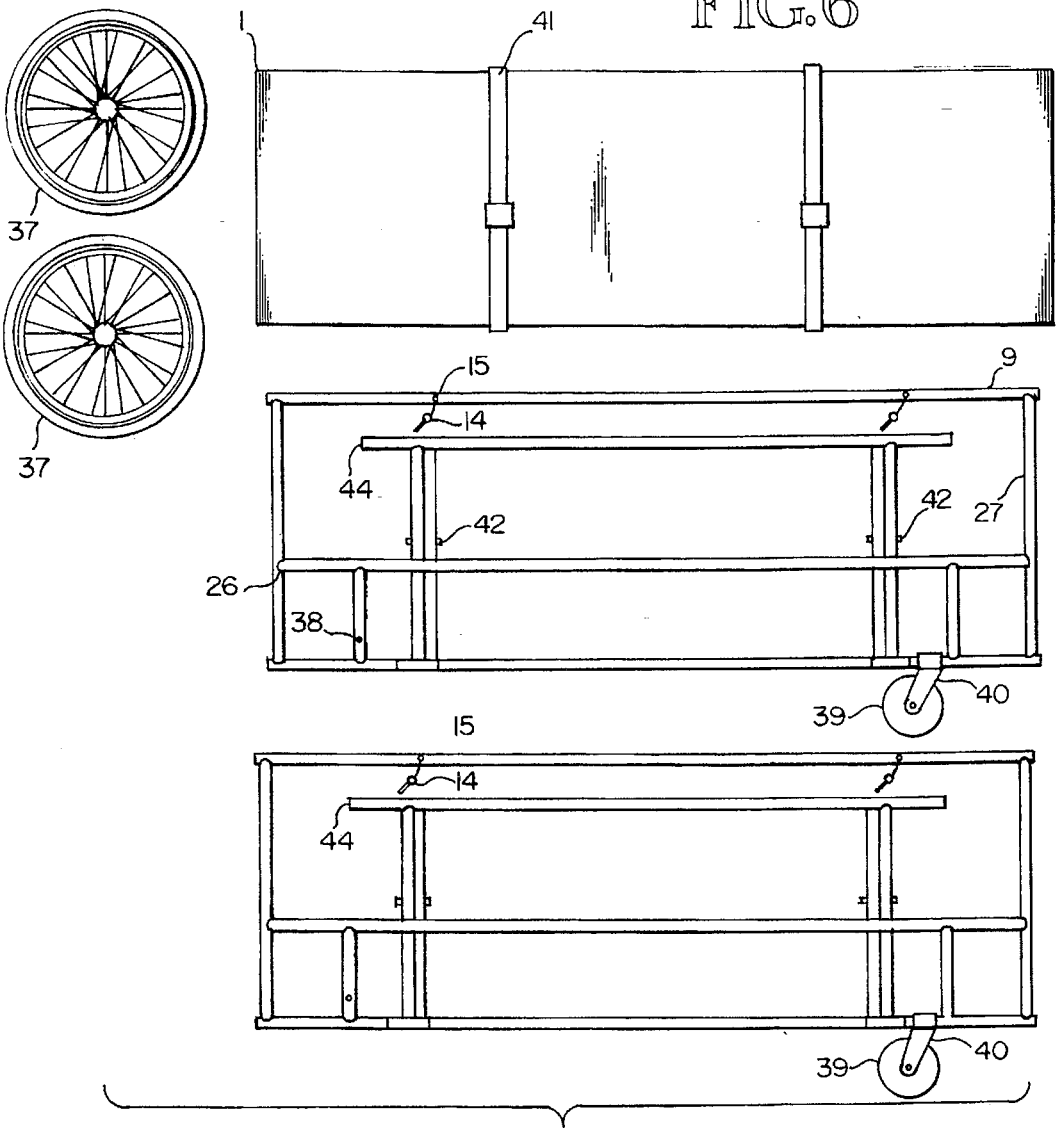
FIG. 6 a side elevational view of my invention in its folded state for travel or storage.

With reference to the drawings and particularly FIGS. 1 and 6 thereof, the preferred embodiment of the Prone Cart of the present invention is there shown and comprises a bed (1), two tubular sides (10), an "X" frame (49) and four wheels, two standard wheel-chair wheels (37) and two small wheels (39). For storage for travel the bed (1) detaches from the tubular sides (10), the standard wheel-chair wheels (37) detach from the tubular sides (10), and said tubular sides fold together via the "X" frame (49).

With reference to FIGS. 1, 4 and 5 the bed (1) is shown to be comprised of ½ inch plywood (2), or other suitably rigid material, of sufficient size to accommodate a patient or other user, overlaid with a suitable cushioning material (3) on the top of the bed, and covered with a stain resistant material (4), such as vinyl, while the bottom of the bed (5) has three equally spaced channels (6), routed out perpendicular to its length so as to accommodate three flat aluminum bars (7), preferably 2 inches wide and ¼ inch thick, which are fixedly attached to the ½ inch plywood (2) by standard bolt means (8). With specific reference to FIG. 4, a quick release fitting (25), for attaching and detaching the bed (1), from the top pair of parallel bars (9) of the tubular sides (10), is shown to be comprised of a saddle clamp (11), anchored to each end of the flat aluminum bars (9) by standard screw means (12), the head of which is counter sunk into the bottom face (13) of the saddle clamp (11) so as not to contact the top pair of parallel bars (9) when the saddle clamp (11) sets astride the top pair of parallel bars (9), and held securely in place by a standard release pin (14), which release pin (14) is permanently secured to the saddle clamp (11) by a standard wire cable (15), so as not to become lost when the release pin (14) is removed for travel or storage of the invention. FIG. 6 discloses two standard security belts with quick release buckles (41), fixedly attached to the bed (1) to stabilize its user.

Figure 7:
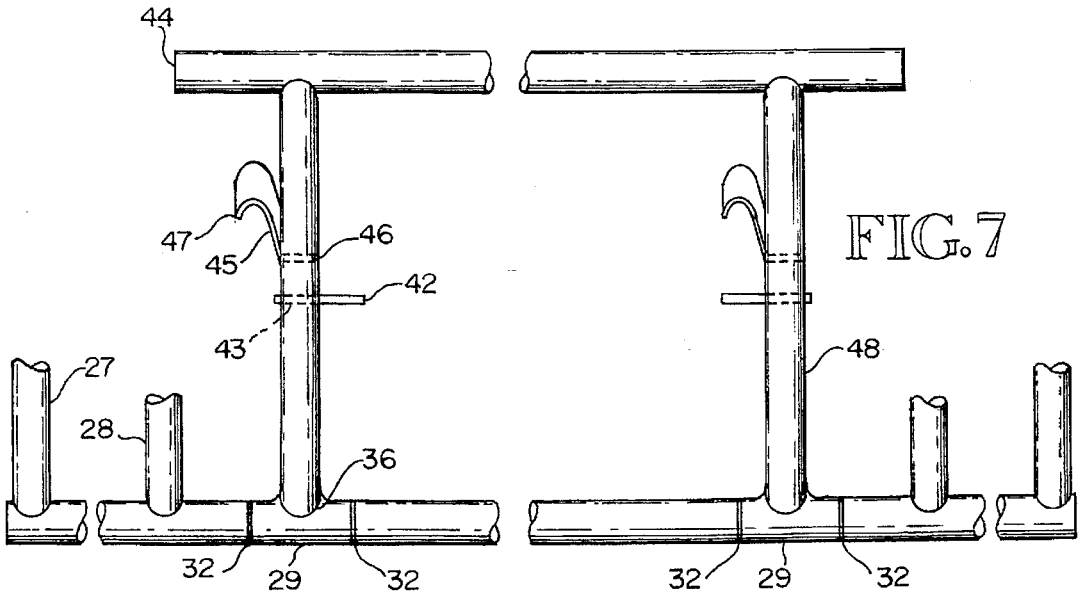
FIG. 7 is an isolated view of one side of the "X" frame.

With reference to FIGS. 3, 6 and 7, the means of joining the sections of the tubular side (10) and the sections of the "X" frame (49) together, other than the base aluminum tube (29) for the "X" frame (49) to the vertical parallel tubes for the "X" frame (48) which is by standard aluminum weld means (6), is by standard cup and bolt means. The preferred embodiment of the invention utilizes T6 6061 Aluminum Tubing 1⅛ inch by 0.065 inch for its tubular members and T6 6061 Aluminum Solid 1¼ inches for the aluminum tubing cap insert (18), said aluminum tubing cap insert (18) being milled out at its top radius (19) to accommodate a 1⅛ inch aluminum tube (20), while its bottom ⅔rds is turned down to 1⅛ inch by 0.990 inch (17) so as to fit inside the T6 0661 Aluminum tubing 1⅛ inch by 0.065. The tube (20) to be mated with the tube cap (18) is joined by standard screw means (21) communicating through the tube to be mated (20) and into a pre-drilled receiving hole of appropriate size and thread, in the aluminum solid (17),(18), said turned-down portion (17) of the tubing cap insert (18) being secured within the Aluminum tubing (16) by means of a standard aluminum rivet nut (23) pressed into a hole, (22), of appropriate dimension, drilled through the aluminum tube (16) and the aluminum solid (17).

With specific reference to FIGS. 1 and 6, there is disclosed the two standard wheel-chair wheels (37) which are mounted on the invention with standard wheel-chair quick disconnect hubs (38) on the vertical strengtheners (28) running from the bottom parallel tube (24) to the mid-pair of parallel bars (26) of the tubular side (10), and the two small wheels (39) rotatably attached by standard caster mounts (40) to the bottom parallel tubes (24) at the end opposite to the standard wheel-chair wheels (37), just inside the vertical strengtheners (28) on that end of the tubular side (10). Vertical parallel bars (27) join the top pair of parallel bars (9) to the bottom parallel tubes (24) of the tubular sides (10), at their ends by standard cup and bolt means described above, and are further stabilized in vertical and perpendicular relation thereto by a mid-pair of parallel bars (26).

With specific reference to FIGS. 2 and 7, the preferred embodiment of the "X" frame (49) is disclosed to be comprised of two identical sections of tubular aluminum construction, each having a base aluminum tube (29), a pair of vertical parallel tubes (48) of sufficient length to span the distance from the bottom parallel tube of the tubular side (24) to the mid pair of parallel bars (26) when the bed (1) is installed on the top pair of parallel bars (9), the two identical sections being rotatably joined, by standard screw and nut means (42) through pre-drilled holes (43) at the mid-point of the length of the vertical parallel tubes (48) for the "X" frame (49). The top parallel tubes (44) of the two identical sections of the "X" frame are slightly shorter than the span of the tubular sides (10) so as to allow the "X" frame (49) freedom of movement. The vertical parallel tubes (48) for the "X" frame are equipped with rigid supports (45) being fixedly attached to said vertical parallel tubes (48) by standard screw means (46), so that the opposite end of said rigid support (45), being of suitable concave shape (47), engages the upper surface of the mid pair of parallel bars (26) of the tubular side (10) when the "X" frame (49) is extended to stabilize the relative position of the components of the invention when the bed (1) is installed on the top pair of parallel bars (9).

The base aluminum tube (29) for the "X" frame is joined by standard aluminum weld means (36) to the one vertical parallel tube (48) and is of identical cross-sectional dimension as the bottom parallel tube (24) of the tubular side (10) so that it is inserted within and becomes a part of the bottom parallel tube (24), being rotatably affixed thereto by means of a solid tube of suitable phenolic material (30), which has the same external diameter as the internal diameter of the base aluminum tube (29) and the bottom parallel tube (24) and of sufficient length to span the base aluminum tube (29) and extend on both ends thereof a sufficient distance into the bottom parallel tube (24) and being anchored in relative position to each tube (24), (29) by standard aluminum rivet means (35) through a hole (33) drilled through the aluminum parallel tube and in the base aluminum tube (29) for the "X" frame (49). The ends of the tubes communicating with each other are protected by standard nylon bushings (32).

Although particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A prone cart being comprised of:

a bed of rigid material for accommodating a patient, having two security belts with quick release buckles and means for attaching the belts to the bed, said bed being overlaid with cushioning material and covered with stain resistant material and having a means for attaching and detaching the bed from a frame;

a frame comprised of two rectangular tubular aluminum sides, each of said sides comprised of a top parallel bar having two ends, a mid parallel bar having two ends, a bottom parallel tube having two ends, and two vertical parallel bars which join the ends of the top parallel bar and the bottom parallel tube and the mid parallel bar by a cup and bolt assembly, while the tubular aluminum sides are strengthened by small vertical tubes located near either end of the mid parallel bar and which communicate with the mid parallel bar and bottom parallel tube, one such small vertical tube having a length and an axle extending perpendicular to the length of the small vertical tube, near its end which communicates to the bottom parallel tube, to accommodate a wheel chair wheel quick disconnect hub;

a pair of wheel chair wheels with quick disconnect hubs mounted on said axles extending from the small vertical tubes on one end of the prone cart;

a pair of small wheels attached to the end of the bottom parallel tubes, opposite to the end at which the wheel-chair wheels are mounted, by caster mounts on the bottom parallel tube, just inside the point at which the small vertical tubes attach to the bottom parallel tubes;

an 'X' frame being comprised of two identical sections of tubular aluminum construction, each having a base aluminum tube, a pair of vertical parallel tubes having a length to span the distance from the bottom parallel tube to the pair of mid parallel bars when the bed is installed on the pair of top parallel bars, the two identical sections being rotatably joined by a screw and nut assembly through pre-drilled holes at the mid-point of the length of the vertical parallel tubes, and having a top parallel tube being slightly shorter than the tubular sides so as to allow the 'X' frame freedom of movement, said vertical parallel tubes being equipped with rigid support means being fixedly attached to said vertical parallel tube by screws, so that the opposite end of said rigid support means, being of concave shape, engages the upper surface of the pair of mid parallel bars when the 'X' frame is extended to stabilize the relative position of the prone cart when the bed is installed on the pair of top parallel bars, while the base aluminum tube for the 'X' frame is joined by weld joints to one of the vertical parallel tubes and is of identical cross-sectional dimension as the bottom parallel tube of the tubular side, so that it is insertable within and becomes a part of the bottom parallel tube of the tubular side, being rotatably affixed thereto by means of a solid tube of phenolic material, having the same external diameter as the internal diameter of the base aluminum tube and the bottom parallel tube and having a length to span the base aluminum tube and extend from both ends thereof a distance into the bottom parallel tube, being anchored in relative position to each tube by aluminum rivets and the communicating faces of the tubes being protected by nylon bushings.

2. The invention disclosed in claim 1, wherein the means for attaching and detaching the bed from the top parallel bars of the two rectangular tubular aluminum sides being comprised of a bed comprised of ½ inch plywood, overlaid with cushioning material on the top of the bed and covered with stain resistant vinyl, while the bottom of the bed has three equally spaced channels routed out perpendicular to its length and extending completely across its span, so as to accommodate three flat aluminum bars, which are fixedly attached to the plywood by bolts and a quick release fitting means being anchored to each end of the flat aluminum bars by screws, said quick release fitting being comprised of a saddle clamp anchored to each end of the flat aluminum bars, so that the saddle clamp sets astride the top pair of parallel bars and is held securely in place by a standard release pin, which release pin is permanently secured to the saddle clamp by wire cables, so as not to become lost when the release pin is removed to fold the prone cart.

* * * * *